United States Patent [19]

Stanford

[11] Patent Number: 4,632,221

[45] Date of Patent: Dec. 30, 1986

[54] BRACING CLAMP FOR SHORING STRUCTURES

[76] Inventor: Joseph S. Stanford, 2300 Finch Ave. West, Unit 41, Weston, Ontario M9M 2Y3, Canada

[21] Appl. No.: 621,550

[22] Filed: Jun. 18, 1984

[51] Int. Cl.[4] ..... E04G 1/16; F16B 7/00

[52] U.S. Cl. ..... 182/179; 182/178; 403/49; 403/385

[58] Field of Search ..... 403/385, 400, 394, 49, 403/396, 397, 171; 182/179, 178

[56] References Cited

U.S. PATENT DOCUMENTS

| | | | |
|---|---|---|---|
| 2,461,762 | 2/1949 | O'Donnell | 403/385 |
| 2,477,696 | 8/1949 | Kohnke | 403/385 |
| 3,385,545 | 5/1968 | Patton | 248/228 |
| 4,011,638 | 3/1977 | Holt | 403/394 |
| 4,059,872 | 11/1977 | Delesanri | 403/385 |

FOREIGN PATENT DOCUMENTS

| | | | |
|---|---|---|---|
| 528214 | 5/1954 | Belgium | 403/385 |
| 1053659 | 4/1951 | France | 403/385 |
| 643513 | 8/1962 | Italy | 403/385 |
| 4231146 | 1/1935 | United Kingdom | 403/385 |

*Primary Examiner*—Ramon S. Britts
*Assistant Examiner*—Alvin Chin-Shue
*Attorney, Agent, or Firm*—Donald E. Hewson

[57] ABSTRACT

Ladder frames for shoring structures are assembled into towers using cross-braces clamped to the columns of the frames. The towers several tiers high are braced one to another by secondary braces, also clamped to the columns of the frames. Disclosed is a connector that permits two secondary braces to be joined to the column at a single location. The connector is such that one secondary brace is set to lie horizontally, whereas the other may lie diagonally. The connector includes bands which may be clamped and tightened onto the columns and braces, and the tightening means is not detachable from the connector; clamping wedges and bolts are provided which are all captive.

10 Claims, 3 Drawing Figures

BRACING CLAMP FOR SHORING STRUCTURES

FIELD OF THE INVENTION

This invention relates to connectors for scaffolding frames, particularly in the use, known as false work, of such frames for shorting structures.

Such a frame comprises a pair of upright columns linked by horizontal stiffeners so that the frame looks like a short ladder. The frame might be of welded or bolted construction, and of steel or aluminum. A shoring structure is made by assembling a series of frames one on top of the other to form a long ladder; two such ladders are disposed adjacent to one another and linked by cross-braces to form a tower; the many towers are linked to each other by secondary braces.

When many hundred frames are to be assembled, the repetitive task of clamping the secondary braces to the columns of the towers becomes quite tedious and time consuming.

PRIOR ART

Quick assembly/release connectors have been proposed with the intention of enabling the clamping of the cross-braces (as opposed to the secondary braces) to the columns to be speeded up. In U.S. Pat. No. 3,807,884 (JUCULANO, Apr. 30, 1974) the cross-braces fit on pre-prepared pins in the columns and are tightened thereto with wedges. However, in the prior art, the shoring user was constrained in his freedom to place the secondary brace wherever he liked on the column, and at whatever angle and orientation he liked, because he had to use the traditional familiar tube-clamp connector. At each joint of secondary brace to column, he had to provide a separate individual clamp. The tube-clamp connectors can only join tubes at a right angle, so that a brace that needed to run diagonally could not be attached directly to a vertical column; only horizontal braces could be attached directly, and therefore the columns and the diagonal braces had to be attached to the horizontal braces. The use of connectors where the respective tube clamps could swivel relatively alleviated this problem to some extent, but still a connector was needed for every joint.

BRIEF DESCRIPTION OF THE INVENTION

It is an aim of the invention to provide a connector that permits a secondary brace to be connected to a column with a wide variety of locations and angles, yet which permits a shoring structure to be assembled in less time than is the case with the simple tube-clamp connectors. It is recognized in the invention that the upright columns invariably are of a much larger section than the secondary braces (since it is the columns which mainly carry the load), and this fact can be exploited by providing the means to clamp not just one secondary brace or tube to the column, but two. The means for clamping the connector to the column comprises a first band, which, since the column has a large section, has a long circumference. Around that circumference there is plenty of room for two more bands, each of which may clamp onto respective secondary braces. Indeed, often there is room for more bands still, for connecting three or four braces per connector. However, there is seldom a need for these extra secondary braces.

The task of connecting the secondary braces to the columns is much simplified by the ability of one connector to clamp two braces to the column.

It is also recognized in the invention that usually one of the two secondary braces that are to be clamped to the column will run horizontally, i.e., at right angles to the column, whereas usually the other of the two secondary braces will run diagonally, though at right angles to a line between the two columns of one ladder frame. A feature of the invention is that the second and third bands of the connector can be arranged so that one of them swivels with respect to the first band, whilst the other is fixed to the first band. Thus, the versatility, and time-saving aspects of the connector are achieved with economy.

A main feature of the invention is the finding of room on the column-band of the connector for two more bands. Although this extra room follows automatically when the column is comparatively thick, the room could be provided by making the column-band longer, in the axial direction. The second and third (and other) bands could then be staggered vertically, so that there would be room for them on the long column-band.

DETAILED DESCRIPTION OF PREFERRED EMBODIMENT

An embodiment of the invention will now be described with reference to the accompanying drawing.

Figure 1:
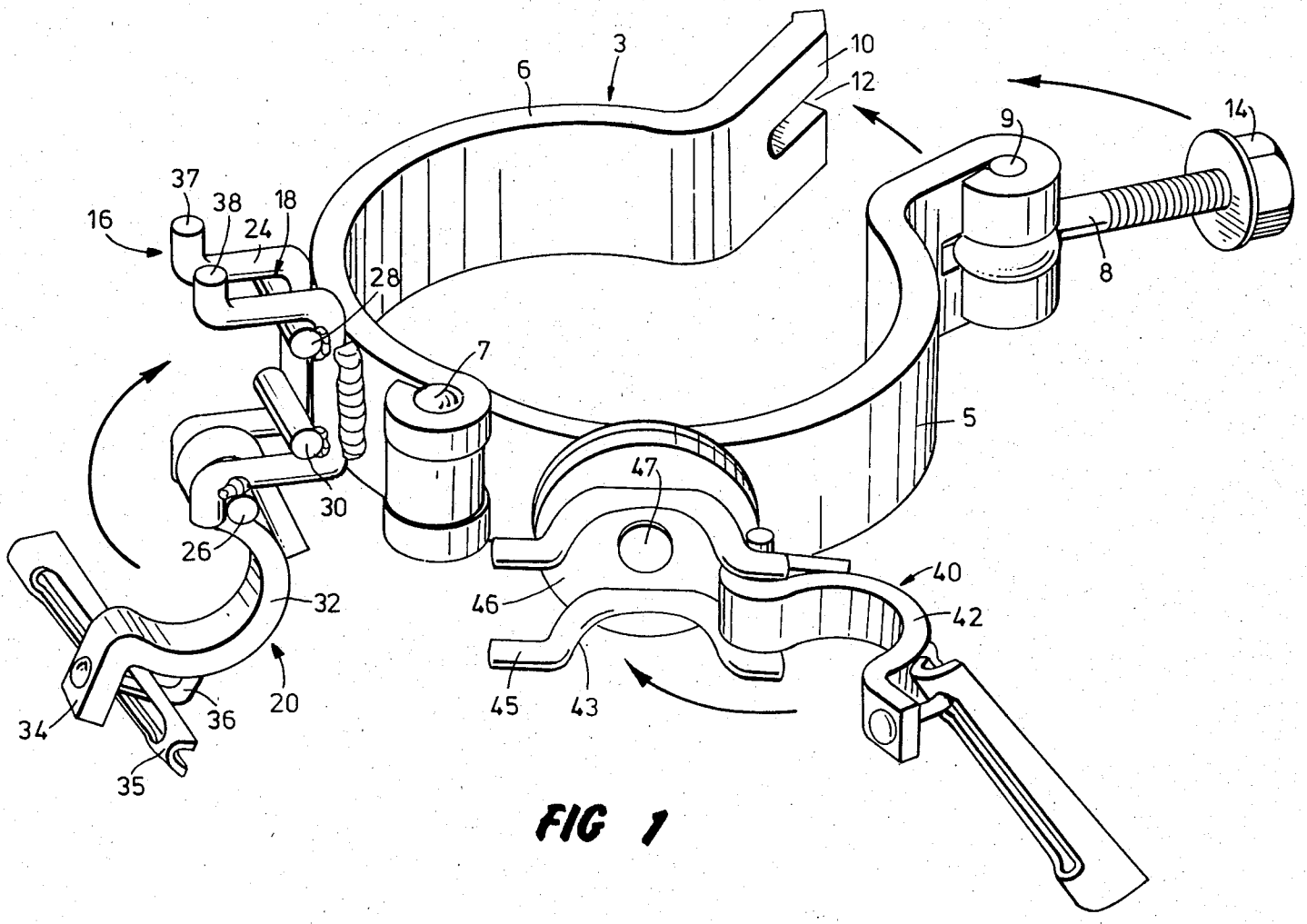
FIG. 1 is a pictorial view of a connector.

The connector 2 includes a first band 3 which is adapted to be fitted around a vertical column 4. The first band 3 is in two parts 5,6 which are hinged together with a hinge pin 7. The parts 5,6 of the first, or column, band 3 are rolled over, as shown in FIG. 1, to receive the hinge pin 7. A clamping bolt 8 is pivoted to a pin 9 mounted in the first band part 5. A platform 10 having a slot 12 is provided in the part 6 to receive the bolt 8. When the bolt 8 is clear of the slot 12, the parts 5,6 may be spread apart and slipped radially over the column 4. The band 3 may then be tightened onto the column 4 by swinging the bolt 8 into the slot 12, and tightening the nut 14 down onto the platform 10.

A second band 16 is fixed to the first band 3. The second band 16 again is in two parts 18,20 one of which 18 is welded to the part 6 of the first band 3. The part 18 comprises two U-shaped rods 24. Straight rods 26,28,30 are welded across the U-shaped rods 24. The part 20 comprises a strap 32, which is pivoted to one of the rods 26. An extension of the strap 32 becomes a platform 34. A wedge 35 is loosely retained to the strap 32 by means of a retainer 36.

The U-shaped rods 24 have extensions 37,38 which also constitute platforms. The platforms 37,38 are arranged to cross and overlap the platform 34: when the parts 18,20 are fitted around a secondary brace 39, the platform 34 lies parallel to the platforms 37,38. In order to tighten the second band 16 onto the secondary brace 39, it is therefore required that the platform 34 must be forced apart from the platforms 37,38. This forcing-apart action is performed by the wedge 35, which is driven between the platform 34 and the platforms 37,38 to tighten the second band 16 onto the secondary brace 39. The wedge 35, is set on the retainer 36 for swiveling either way, so that it may be set to be driven either upwards or downwards to tighten the band 16. The second band 16 is disposed so that the secondary brace 39 lies at right angles to the column 4, and can lie in no other position.

The third band 40 is very similar to the second band 16. The band 40 is in two parts 42,43 which can be separated and then clamped together onto another secondary brace 44.

The main difference between the two bands 16,40 is that the third band 40 may swivel, whereas the band 16 was fixed in its orientation relative to the first band 3. The U-shaped rods 45 of the third band 40 are welded to a turntable 46. A headed pin 47 passes through a hole in the part 5 of the first band 3, and is welded or riveted to the turntable 46. The axis about which the third band 40 may swivel is thus radial to the column 4.

The connector described has no separable components. Nothing need be removed or separated from the connector when assembling columns and braces. It will be appreciated that the use of the wedges, as described, to tighten the bands is not essential: any suitable means of clamping the bands tight will do. Not needing any extra components except those that are on the clamp is a very worthwhile feature however.

The connector 2 has been described as suitable for clamping secondary braces to a column of a much larger section than the braces: if the sections were the same size, or nearly so, there would not be room for both the second and third bands to be positioned around the circumference of the first band, unless, as mentioned earlier, the second and third bands were staggered along the length of an especially long first band. On the other hand, neither the column nor the braces need be circular, and indeed it is common practice to make the columns of aluminum (or heavy duty steel) shoring frames out of square tube. The first band 3 is then simply shaped appropriately.

Figure 2:
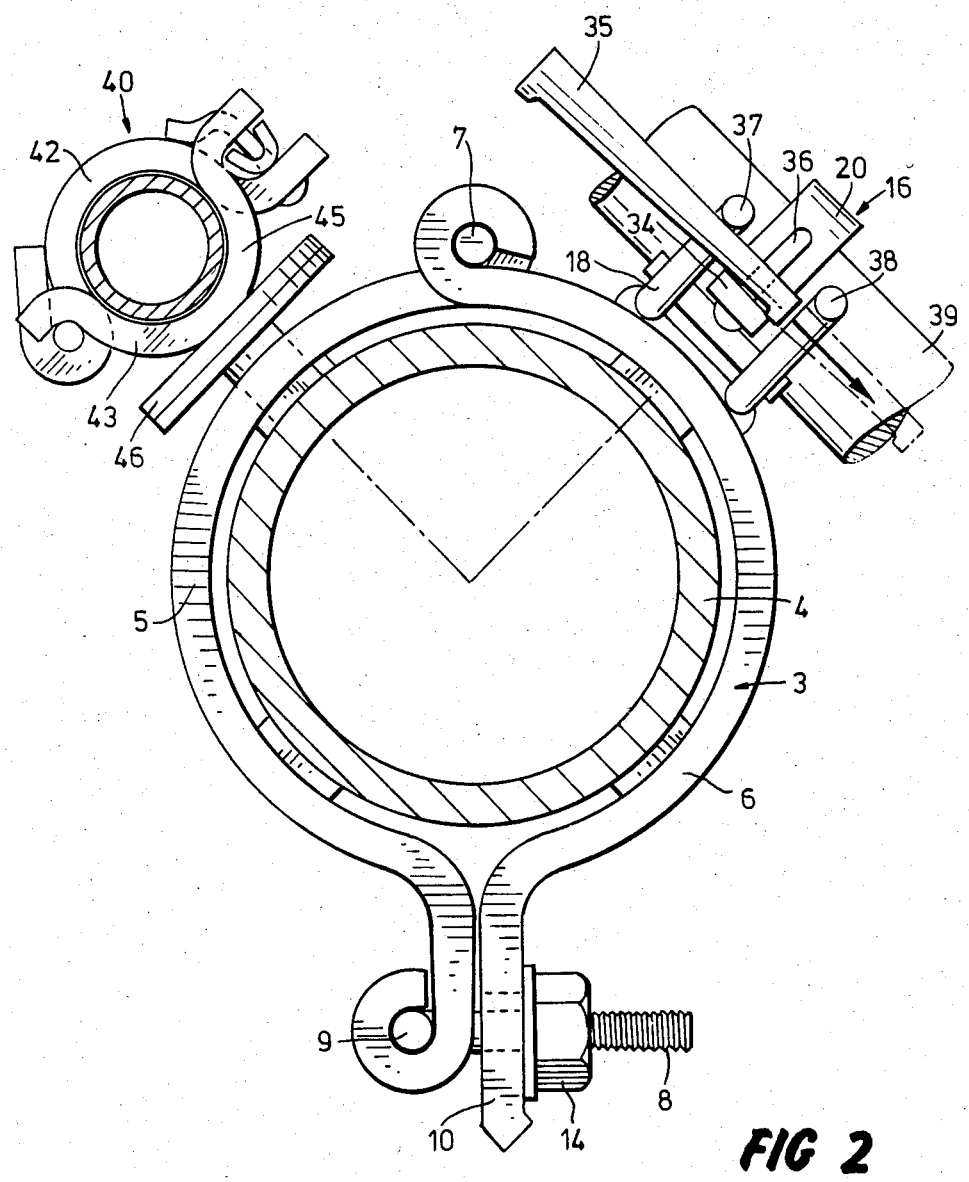
FIG. 2 is a plan view of the connector of FIG. 1 assembled to a column and to two secondary braces.
Figure 3:
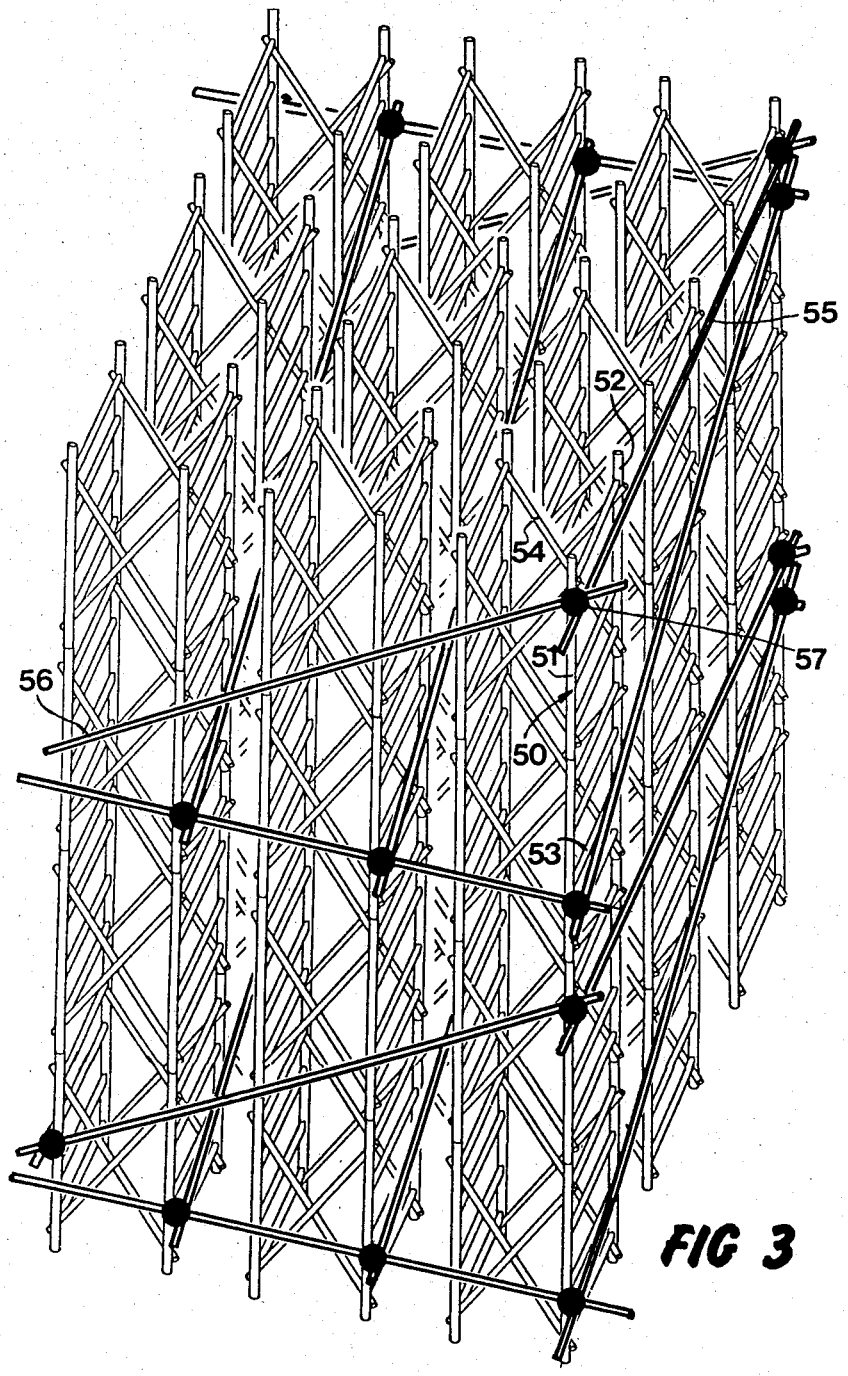
FIG. 3 is a pictorial view of a connector used in conjunction with shoring frames.

FIG. 3 shows how a connector similar to that shown in FIGS. 1 and 2 might typically be arranged in a shoring structure. A ladder-frame 50 has upright columns 51,52 linked by stiffeners 53, in a composite structure of aluminum or steel. The frame 50 is jointed to other similar frames by means of cross-braces 54 which are attached to the frames by means of traditional cross-brace connectors (such as the JUCULANO connector mentioned earlier, for example). The frames thus form towers. Nine such towers are shown in FIG. 3.

A secondary brace 55 runs horizontally and another secondary brace 56 runs diagonally downwards from the top of the column 51. The secondary brace 56 is assembled into the third, swiveling, band 40 of a clamp 57, and the secondary brace 55 to the second band 16. Many more frames, towers, secondary braces, and connectors would be present in a real shoring structure: FIG. 3 is illustrative just of the method of connection, not of the quantities used. The heavy dots on FIG. 3 illustrate locations where the clamps of the invention would be used. (FIG. 3 is intended to illustrate typical locations in which the clamp of the invention can be advantageously used. FIG. 3 should not be taken as an illustrative of a finally-assembled and finished shoring structure.)

It will be seen that the connector of the invention provides a shoring system of great versatility. The towers may be spaced to suit the needs of the particular job with little restriction on the spacing or layout being caused by the clamps. Secondary braces may be assembled at any angle permitted by the movement of the swiveling band. In a working set or outfit of the connector, most would be formed with one fixed band and one swiveling band, but some would be provided with two swiveling bands to cater for the case where the frames rest on very uneven ground, or for other unusual circumstances.

Moreover, especially when flying shoring tables comprising a plurality of pre-assembled frames, the present invention permits a saving in the weight to be lifted and flown by cutting back on the number of tube-and-clamp connectors required by nearly 50%.

Since loads are fed into a column from two secondary braces both at the same point on the column, only a minimum of bending and buckling forces are imposed on the upright columns. This can be important when the towers are very high, and the secondary braces are long and are attached each to several frames.

What is claimed is:

1. Connector for shoring structures and the like, comprising:

a first band, arranged in two parts which are pivotedly connected to be movable to allow the band to be fitted onto and around a vertical column;

a first means for tightening the two parts of the first band together so that the band grips the column;

a second band, secured to the first band, and arranged in two parts that are movable to allow the second band to be fitted onto and around a first brace of smaller section than the column;

a second means for tightening the two parts of the second band together so that the second band grips the first brace independently of the means for tightening the first band;

a third band, secured to the first band independently of the second band, and arranged in two parts that are movable to allow the third band to be fitted onto and around a further brace of smaller section than the column; and a third means for tightening the two parts of the third band together so that the third band grips the further brace, independently of the first means for tightening the first band, and independently of the second means for tightening the second band;

said second and third bands are positioned on opposite sides of the pivotal connection wherein said second band is spaced, in the circumferential sense relative to the column, at right angles to the said third band;

wherein said second and third bands are each at substantially the same height, relative to said first band;

and wherein the axis of the column and the axis of said first brace are spaced slightly apart from each other at right angles to each other when viewed from above, and wherein the axis of the column and the axis of said further brace are space slightly apart from each other at right angles to each other when viewed from above;

whereby said column and said first and further braces may be placed with their respective axes all mutually perpendicular one to another, when viewed from above along the axis of said column, and said axes substantially intersect one another at said connector.

2. Connector as claimed in claim 1, wherein the second and third bands are secured to the first band in a non-detachable permanent manner.

3. Connector as claimed in claim 1, wherein the components of the connector do not need to be detached and separated from the connector at the time that the connector is assembled to and tightened onto the vertical column and the braces.

4. Connector as claimed in claim 1 , wherein one of either the second or third bands is mounted on the first band for swiveling.

5. Connector as claimed in claim 4, wherein the brace that is gripped by the swiveling band swivels about an axis that is radial to the column, and in a plane that is at right angles to the other brace.

6. Connector as claimed in claim 4, wherein the other of the second or third bands is immovably attached to the first band.

7. Connector as claimed in claim 1, wherein the parts of the second band are each formed with a respective protruding platform, which when the second band is gripping its brace, are parallel to each other and to a radius of the brace, and wherein the second tightening means comprises a wedge that is adapted to be driven between the respective platforms.

8. Connector as claimed in claim 7, wherein the parts of the third band are each formed with a respective protruding platform, which when the third band is gripping its brace, are parallel to each other and to a radius of the brace, and wherein the third tightening means comprises a wedge that is adapted to be driven between the respective platforms.

9. A system of shoring structures or the like, excluding connectors of claim 1, the system comprising:

frames having two upright columns joined by stiffeners;

where the frames are ladders arranged one above another;

where the ladders are locked together by cross-braces in regular, spaced-apart formation to form towers;

where a first secondary brace is connected to one of the column of one of the frames and lies in a plane that is parallel to that frame;

where a second secondary brace is connected to the said one of the columns and lies in a plane at right angles to that frame;

where the two secondary braces are of a smaller section than the column; and where the secondary braces are connected to the columns by said connectors.

10. The system of claim 9, wherein, of the two secondary braces clamped to that connector, one is horizontally disposed and the other is diagonally disposed.

* * * * *